US005743057A

United States Patent [19]

Martin

[11] Patent Number: 5,743,057

[45] Date of Patent: Apr. 28, 1998

[54] AUXILIARY DOOR AND METHOD FOR MATCHING A SECTIONAL DOOR

[75] Inventor: David O. Martin, Salt Lake City, Utah

[73] Assignee: Martin Door Manufacturing, Inc., Salt Lake City, Utah

[21] Appl. No.: 401,557

[22] Filed: Mar. 9, 1995

[51] Int. Cl.[6] ..... E04C 2/30

[52] U.S. Cl. ..... 52/457; 52/458; 52/309.9; 52/784.13; 52/784.15; 52/800.13; 49/501

[58] Field of Search ..... 52/455–458, 309.9, 52/784.1, 84.13, 784.15, 796.1, 797.1, 800.12, 800.13; 49/501

[56] References Cited

U.S. PATENT DOCUMENTS

| | | | |
|---|---|---|---|
| 2,825,099 | 3/1958 | Simmons | 52/455 |
| 3,328,927 | 7/1967 | Kates | 52/800.12 X |
| 3,334,464 | 8/1967 | Charles | 52/309.9 X |
| 3,455,078 | 7/1969 | Brown et al. | 52/784.13 |
| 4,716,705 | 1/1988 | Formanek | 52/784.1 |
| 4,752,517 | 6/1988 | Bertel | 49/50 X |
| 5,285,608 | 2/1994 | Costello | 52/456 |

FOREIGN PATENT DOCUMENTS

| | | | |
|---|---|---|---|
| 0414869 | 8/1946 | Italy | 52/456 |

*Primary Examiner*—Robert Canfield
*Attorney, Agent, or Firm*—J. Winslow Young

[57] ABSTRACT

A door assembled from a plurality of discrete lengths of door section, the door sections being identical in appearance to the door sections of an adjacent sectional door. The length of each discrete length of door section is selectively predetermined in order to produce the door with the correct width. A body of foam is placed in each discrete length of door section for insulative and structural support purposes. One or more blocks of wood can be included at preselected locations inside the door for mounting purposes. A unitary backing sheet is affixed to the back surface of the door to provide the door with a monocoque construction while the peripheral edges of the door are enclosed in a U-shaped channel member.

13 Claims, 3 Drawing Sheets

AUXILIARY DOOR AND METHOD FOR MATCHING A SECTIONAL DOOR

BACKGROUND

1. Field of the Invention

This invention relates to doors and, more particularly, to a novel auxiliary door apparatus and method for providing an auxiliary door for placement adjacent a sectional door with the auxiliary door being constructed as a unitary door from discrete lengths of identical door sections as the adjacent sectional door.

2. The Prior Art

Sectional doors are used throughout the world, particularly in the industrialized nations, as the closure of choice for large openings, that is, openings greater than, say, two or more meters wide. The sectional door is so named by reason of its construction in that a plurality of elongated planar door sections are hingedly joined edge to edge to create the sectional door. The length of the door sections is chosen to correspond to the width of the opening to be covered by the sectional door while the height and number of the door sections are selectively predetermined to produce a sectional door operable to close the opening across which it is mounted. Vertically oriented support tracks on each side of the opening support the sectional door in its vertical or closed position. These vertical tracks continue upwardly across curved sections in the respective tracks into generally horizontal tracks. These elevated, horizontal tracks support the sectional door interiorly and above the opening which is closed when the sectional door is lowered to its vertical, closed position. Sectional doors in warehouse-type applications are generally carried upwardly across a slightly curved track and held above the opening in a generally vertical position above the opening, hence the generic name for these doors "overhead doors."

As a general rule, each door section in most sectional doors is configured with some type of embossed pattern in order to improve the wind loading characteristics of the sectional door while at the same time imparting a pleasing visual appearance to the sectional door. These patterns vary considerably among the various manufacturers and range from the simple continuous, horizontal channels along the entire length of the door section to a plurality of discrete panels formed into the face of the door section.

In many sectional door applications a separate, smaller opening is provided adjacent the larger opening as a convenient access for persons entering or leaving the structure. The smaller opening provides convenient access and eliminates the need for frequent operation of the considerably larger sectional door. These smaller openings are customarily closed by the simple expedient of installing a conventional, hinge-mounted door in the opening. However, since sectional doors are assembled from a plurality of door sections and each set of door sections is fabricated with its own unique design, there are no conventional doors that have the same visual appearance as the adjacent sectional door. Further, since sectional doors are by their very nature fabricated from a plurality of door sections, no conventional door is ever likely to be fabricated to visually resemble a sectional door. This problem is further exacerbated by the fact that many of these smaller openings are what could be considered to be non standard in size, for example, sizes as small as 2.4 feet (0.73 meters) to five feet (1.52 meters) wide and between about five feet (1.52 meters) to 10 feet (3.3 meters) or more, high. Conventional doors simply are not available with these different designs nor are they available in this extreme range of sizes.

In view of the foregoing it would be an advancement in the art to provide an auxiliary door for a smaller opening adjacent a sectional door, the auxiliary door being constructed from door sections in order to have the auxiliary door match the visual appearance of the sectional door. It would also be an advancement in the art to provide an auxiliary door fabricated from door sections wherein the door sections are securely mounted together by a unique assembly to provide the auxiliary door with the desired degree of dimensional integrity. Such a novel apparatus and method is disclosed and claimed herein.

BRIEF SUMMARY AND OBJECTS OF THE INVENTION

This invention relates to a novel door apparatus and method whereby a conventional-type door is fabricated from lengths of door sections which are identical to the door sections in the adjacent sectional door thereby providing the door with the identical visual appearance as the sectional door. The lengths of door sections are held together in a monocoque construction by a unitary sheet of metal riveted to the back surface of the door. The hollow core of the door is filled with a synthetic foam insulation such as styrofoam or polyurethane foam. Edge closures having a U-shaped cross section are mounted to the exposed edges of the door. Blocks of wood are mounted inside the door to provide structural support for door knobs, closure apparatus, and the like.

It is, therefore, a primary object of this invention to provide improvements in auxiliary door apparatus.

It is another object of this invention to provide improvements in the method of providing a door fabricated from door sections.

Another object of this invention is to provide an auxiliary door having the identical visual appearance as an adjacent sectional door.

Another object of this invention is to provide a door fabricated from door sections, the door having sufficient structural integrity to accommodate the door being used in a conventional manner.

Another object of this invention is to provide a door fabricated from a plurality of discrete door sections with the door sections rigidly mounted together to form the door.

Another object of this invention is to provide a door fabricated from a plurality of discrete door sections and having a sheet of metal on the back face thereof to provide the door with improved dimensional integrity.

These and other objects and features of the present invention will become more readily apparent from the following description with its accompanying drawing and the appended claims.

DETAILED DESCRIPTION OF THE PREFERRED EMBODIMENT

Figure 1:
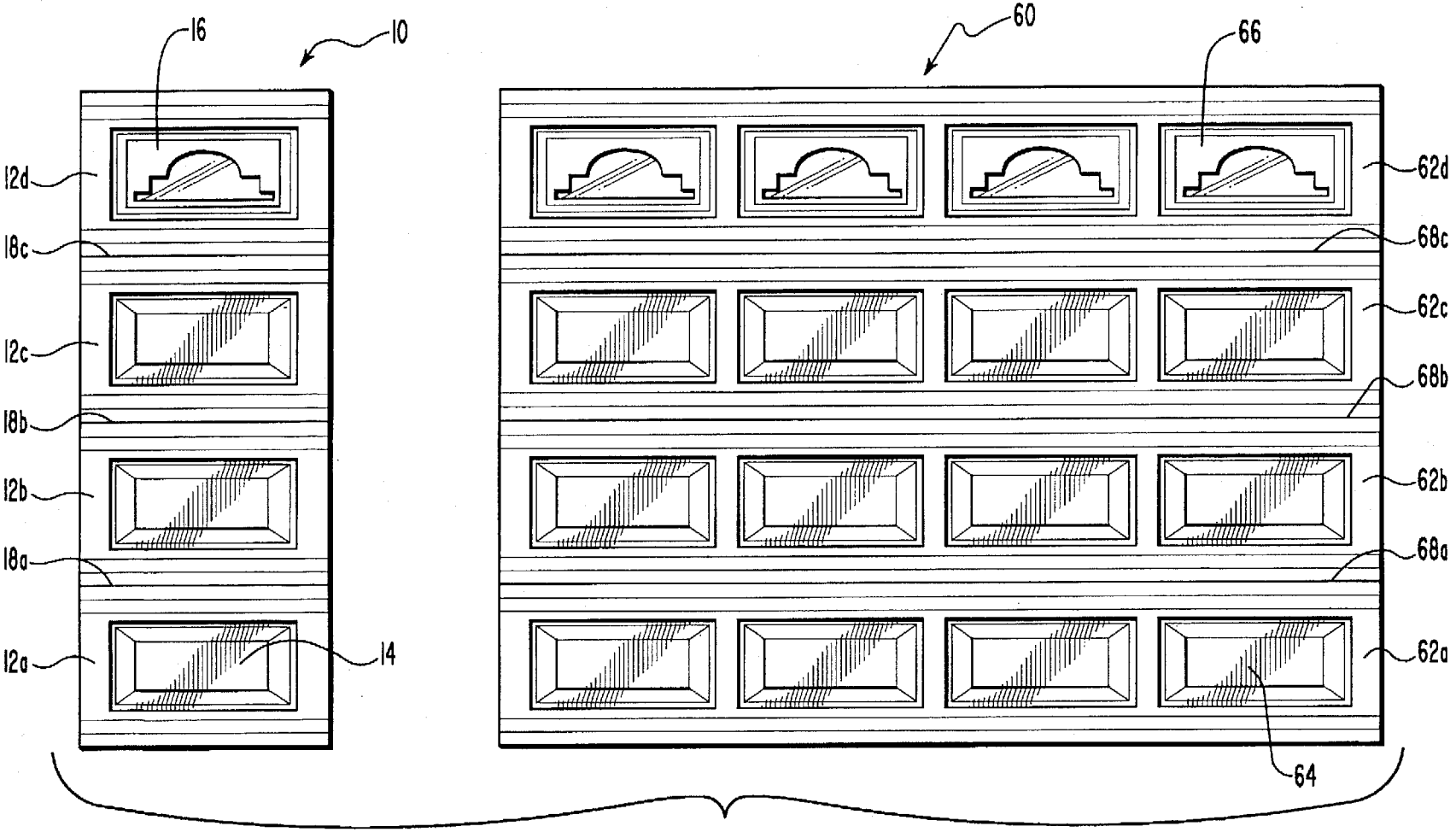
FIG. 1 is a front elevation of one presently preferred embodiment of the novel door apparatus of this invention shown in the environment of a conventional, sectional door.

The invention is best understood by reference to the drawing wherein like parts are designated by like numerals throughout in conjunction with the following description.

General Discussion

The novel door of this invention is fabricated from a plurality of discrete lengths of door sections that are identical to those door sections that have been assembled into the sectional door. However, instead of being hingedly joined together in the edge-to-edge relationship of the sectional door, the discrete lengths of door section are secured together in a monocoque construction by a unitary sheet of metal. The back surface of the door is then covered with a backing sheet which is a single sheet of metal which thereby provides the door with a remarkable degree of dimensional integrity. The exposed edges of the door section and the backing sheet are enclosed within the confines of edge closures which have a U-shaped cross section and are mounted over the peripheral edges of the door. This type of monocoque construction has proven extremely valuable in the fabrication of an aircraft fuselage, rocket body, or other structure wherein the outer skin carries all or a major part of the stresses imposed on the structure. In this case, the back facing of the door along with the peripheral channel members support the individual door sections as an integral door unit of exceptional rigidity. The door is also very light weight and is insulated by having slabs of synthetic foam inserted into each door section prior to assembly. Wood blocks can also be mounted inside the door sections at predetermined locations to provide additional structural support for the door handle, crash bar, and/or closer apparatus.

The door is assembled by assembling each door section separately prior to joining the door sections together into the door. The first step involves cutting facings from the sheet steel sections, each facing having a predetermined length. Slabs of synthetic foam and any wood blocks are inserted into the facings and end stiles are attached thereto to create the discrete door sections. A predetermined number of these door sections are aligned together and secured as a unit by a sheet of back facing which is secured to the end stiles of the door sections. Edge closures in the form of elongated channel members are used to enclose all exposed edges of the door along with the peripheral edge of the back facing.

Detailed Description

Referring now to FIG. 1, the novel door of this invention is shown generally at 10 and includes a plurality of door sections 12*a*–12*d* joined edge to edge into door 10. Door 10 is shown in the environment of a conventional, sectional door 60 which is fabricated from door sections 62*a*–62*d*. Door sections 62*a*–62*d* are hingedly joined together in an edge-to-edge relationship to adapt sectional door 60 to being raised upwardly as is conventional for these types of doors. Door sections 62*a*–62*c* are each configured with an identical design 64 therein while the corresponding portions of door section 62*d* are configured to include a decorative window 66 therein. Accordingly, the presence of design 64 in door sections 62*a*–62*c* coupled with the decorative window 66 in door section 62*d* imparts an overall visually pleasing appearance to sectional door 60. Door 10 is likewise fabricated from discrete door sections 12*a*–12*d* each of which has a corresponding visual appearance of the adjacent sectional door 60. Specifically, each of door sections 12*a*–12*c* has a design 14 formed therein, design 14 being identical to design 64 of sectional door 60. Correspondingly, door section 12*d* includes a decorative window 16 therein, decorative window 16 being identical to decorative window 66 of sectional door 60.

Importantly, door 10 is specifically fabricated from discrete lengths of door sections 12*a*–12*d* which have been previously cut from the identical door section material as door sections 62*a*–62*d*. In this manner door 10 achieves the identical appearance as that of a sectional door 60. However, while sectional door 60 has been assembled from individual door sections hingedly joined together along the respective joints 68*a*–68*c*, door 10 is a unitary element in that there are no hinges or joints along the corresponding abutment lines 18*a*–18*c*. Abutment lines 18*a*–18*c* exist solely because door 10 is fabricated from discrete lengths of door sections 12*a*–12*d* in order to be able to provide door 10 with the identical visual appearance as sectional door 60. Advantageously, this unusual construction technique accommodates the fabrication of door 10 to meet almost any size constraint for the opening (not shown) into which door 10 is to be hingedly mounted.

Figure 2:
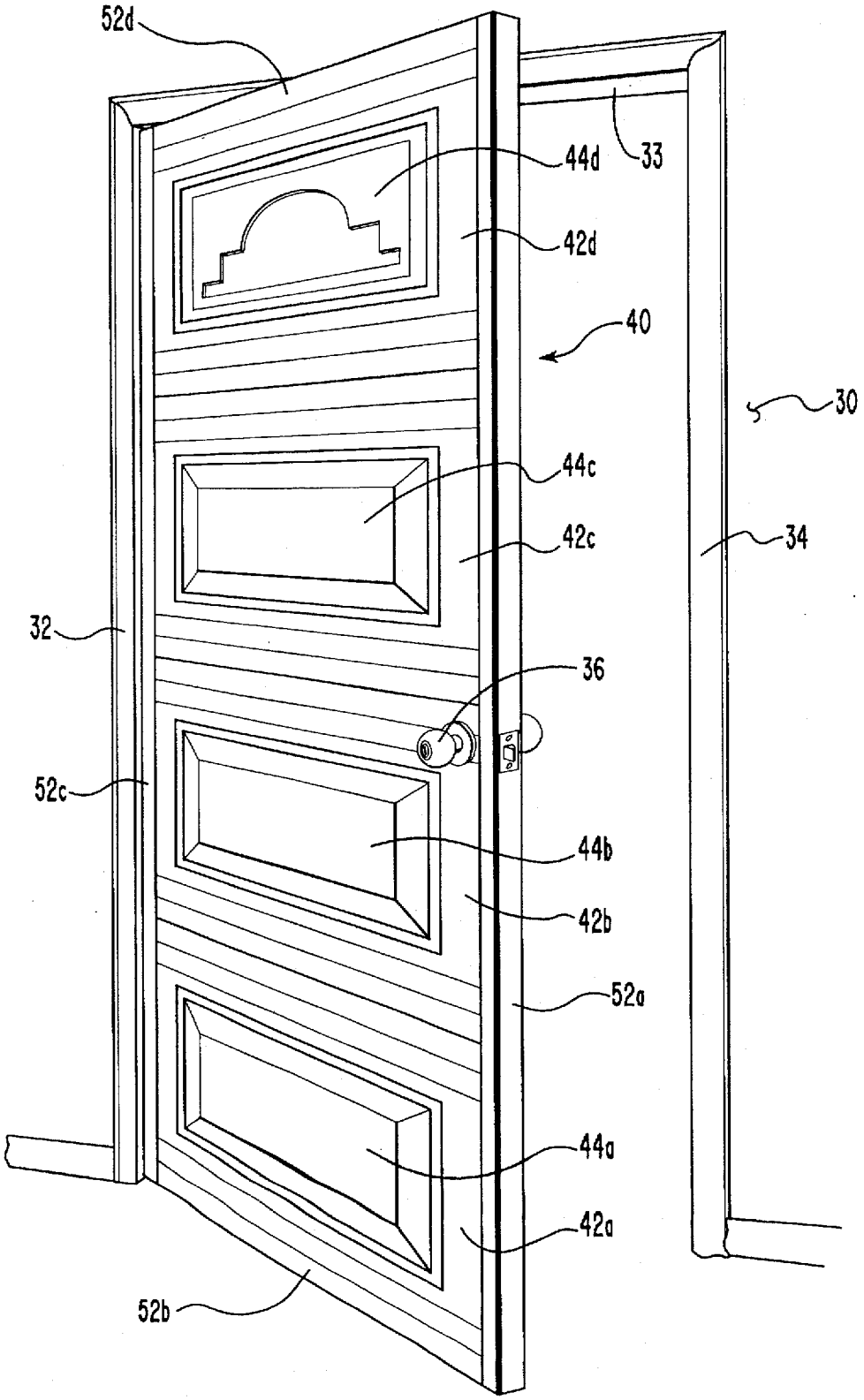
FIG. 2 is a perspective view of a second embodiment of the novel door apparatus of this invention shown in the environment of a door jamb.

Referring now to FIG. 2, a second preferred embodiment of the novel door of this invention is shown generally at 40 and in the environment of a door jamb 30 to which door 40 is hingedly mounted by a plurality of hinges (not shown). Specifically, door jamb 30 includes a left upright 32 and a right upright 34 with an upper, horizontal crosspiece 33 connecting the top of the left upright 32 to the top of the right upright 34. Door 40 is, therefore, hingedly mounted to left upright 32.

Door 40 is assembled from a plurality of door sections, door sections 42*a*–42*d*, which are held in place, in part, by a plurality of edge closures 52*a*–52*d* mounted to the peripheral edges of door 40. Door 40 is fabricated from a plurality of door sections 42*a*–42*d* each of which has a predetermined design 44*a*–44*d*, respectively, formed thereon. The selection of the number and length of door sections 42*a*–42*d* is determined by the size of jamb 30 into which door 40 is to be mounted. Correspondingly, the specific visual appearance of design 44*a*–44*d* is also predetermined by the specific design characteristics of the adjacent sectional door (not shown). However, see FIG. 1 for an illustration of this novel feature of matching designs between door 10 and sectional door 60. Door 40 also includes a door knob 36 which is used to latch door 40 to jamb 30. Door knob 36 and jamb 30 are shown herein for purposes of illustration for showing the environment of door 40 and as such do not constitute a part of this invention.

Figure 3:
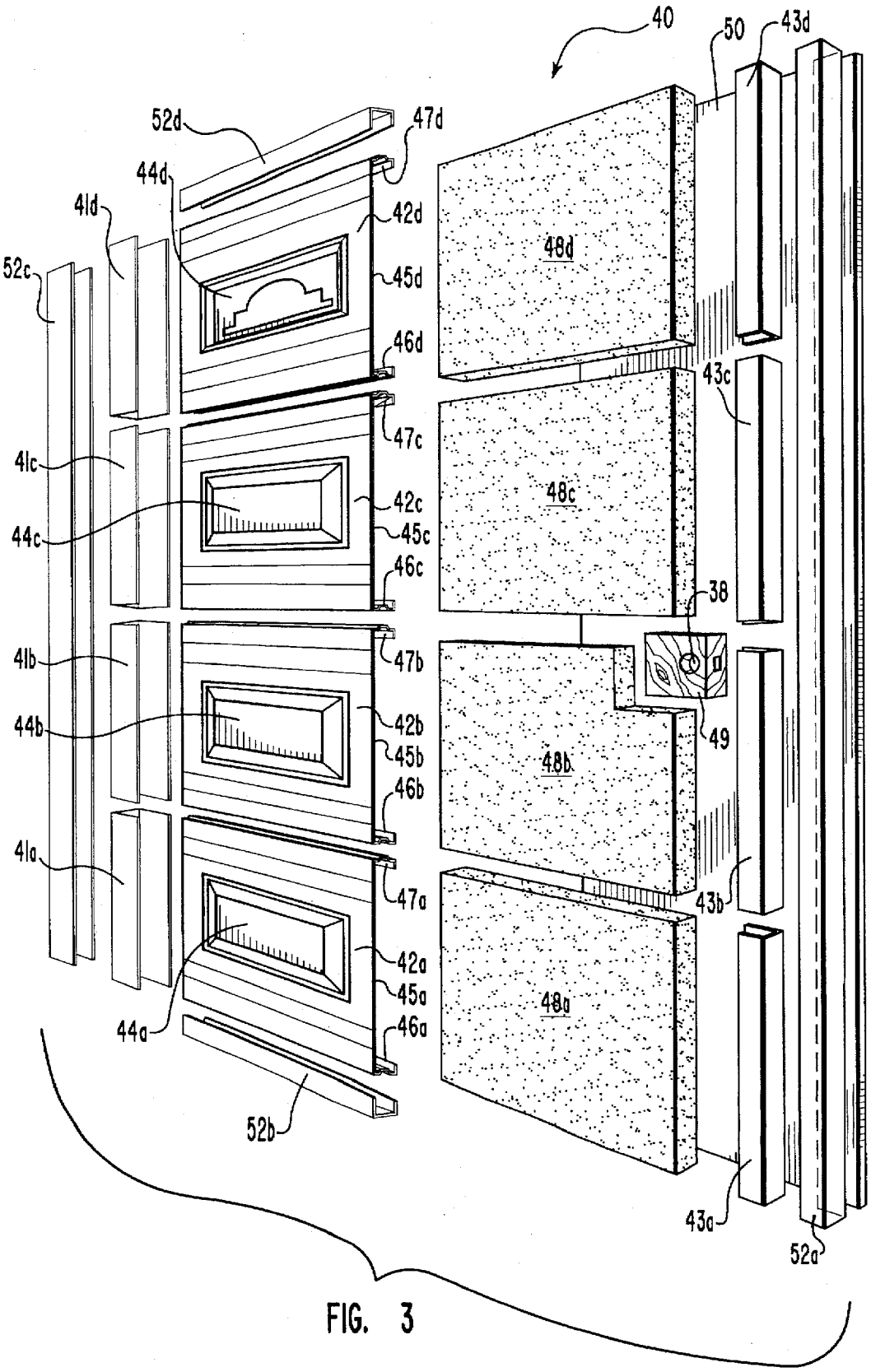
FIG. 3 is an exploded perspective view of the door of FIG. 2 showing the interrelationship of the various components thereof.

Referring now to FIG. 3, door 40 is shown in this exploded, perspective view in order to more clearly set forth the various features that make door 40 unique. Specifically door 40 is assembled from a plurality of door sections 42*a*–42*d*, each of which is respectively fabricated from a panel facing 45*a*–45*d* having a body of synthetic foam 48*a*–48*d* therein and enclosed at each end by a left end stile 41*a*–42*d* and a right end stile 43*a*–43*d*. Panel facing 45*a*–45*d* includes the front, decorative panel 44*a*–44*d* along with a lower return 46*a*–46*d* and an upper return 47*a*–47*d*. Left end stile 41*a*–41*d* and right end stile 43*a*–43*d* are each inserted between panel facings 45*a*–45*d* and lower return 46*a*–46*d* and upper return 47*a*–47*d*. However, prior to completing the assembly of left end stile 41*a*–41*d* and right end stile 43*a*–43*d* to panel facing 45*a*–45*d*, a body of synthetic foam 48*a*–48*d* is placed into the enclosure formed between panel facing 45*a*–45*d* and lower return 46*a*–46*d* and upper return 47*a*–47*d*. Thereafter left end stile 41*a*–41*d* and right end stile 43*a*–43*d* are secured to panel facing 45*a*–45*d*. This configuration for door sections 42*a*–42*d* is essentially conventional art and has been widely used in the sectional door industry.

Door 40 is assembled from door sections 42*a*–42*d* which are aligned into the configuration of door 40 with a unitary sheet of metal, backing sheet 50 mounted thereto by being secured along its periphery to left end stiles 41*a*–41*d* and right end stiles 43*a*–43*d*. Adhesives can also be applied between sheet metal 50 and the outer faces of lower return 46*a*–46*d* and upper return 47*a*–47*d* so as to eliminate any rippling or "tin can" effect that would otherwise be present if adhesives were not used. It should be noted that the various adhesives and fasteners are not shown herein for purposes of simplicity and by reason that these devices are well known in the art. The attachment of backing sheet 50 to the back surface of door sections 42*a*–42*d* provides door 40 with a very rigid construction along the lines of a monocoque construction in that the outer skin of backing sheet 50 and that of panel facing 45*a*–45*d* provides door 40 with a construction that is very highly stable dimensionally. Door 40 is completed by the securement of edge closures 52*a*–52*d* to the respective edges of the periphery of door 40. Edge closures 52*a*–52*d* are configured with a generally U-shaped cross section, the spacing between the two arms of the U-shaped cross section being configured to receive therein the respective edges of door sections 42*a*–42*d* along with the corresponding peripheral edges of backing sheet 50. In this manner any otherwise exposed edges are enclosed within the U-shaped configuration of edge closures 52*a*–52*d*.

A block 49 is prepared from a suitable material such as wood and is inserted into door section 42*b* to serve as the anchor mechanism for door knob 36 (FIG. 2). Specifically, a cutout section 39 is created in synthetic foam 48*b* with the dimensions of cutout section 39 being coordinated with the dimensions of block 49 so that block 49 will be securely held within the confines of door section 42*b*. A hole 38 in block 49 is configured to receive therethrough the mechanism of door knob 36.

The Method

Door 40 is prepared by obtaining a predetermined number of facing panels 45*a*–45*d* and assembling the same into door sections 42*a*–42*d*. The precise number, size, and length of facing panels 45*a*–45*d* are selectively predetermined in order to provide door 40 with the necessary external dimensions. Further, decorative panels 44*a*–44*d* are also coordinated with the adjacent sectional door such as sectional door 60 (FIG. 1) in order to impart to door 40 the identical visual appearance as is found on both door 10 and sectional door 60 as shown in FIG. 1.

Synthetic foam 48*a*–48*d* is then placed against the inner face of facing panel 45*a*–45*d* and held therein upon mounting each of left end stile 41*a*–41*d* and right end stile 43*a*–43*d* to facing panel 45*a*–45*d*. A block 49 is included in synthetic foam 48*b* during the foregoing assembly procedure.

With the individual door sections 42*a*–42*d* assembled, they are then placed into juxtaposition in an edge to edge relationship in order to have backing sheet 50 secured thereto. Backing sheet 50 transforms the separate door sections 42*a*–42*d* into door 40. With door 40 assembled, the exposed edges of door sections 42*a*–42*d* and the corresponding peripheral edges of backing sheet 50 are enclosed within the confines of the U-shaped configuration of edge closures 52*a*–52*d*.

In summary, while each of door sections 42*a*–42*d* represent a fairly strong component for door 40, they are only useful in combination in door 40 through the mounting thereto of backing sheet 50. Edge closure 52*a*–52*d* provide additional structural support although the primary structural support for door 40 is supplied by the monocoque construction principle provided through backing sheet 50.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A door comprising:

a plurality of discrete lengths of door section facing, each said door section facing comprising a steel sheet formed into a front panel, a top edge, and a bottom edge, said front panel having a design formed therein, said top edge including a top return spaced from said front panel, said bottom edge including a bottom return spaced from said front panel;

a backing sheet mounted to the back of said length of door section facing to create a unitary door element, said backing sheet holding said unitary door element together as a door, said door having a peripheral edge; and closure means for enclosing said peripheral edge.

2. The door defined in claim 1 wherein each said door section facing includes a slab of synthetic foam mounted within said door section facing between said front panel and said top return and said bottom return.

3. The door defined in claim 2 wherein each said door section facing includes a first end and a second end, each said door section facing having a first end stile mounted to said first end between said front panel and said top return and said bottom return, each said door section facing also having a second end stile mounted to said second end between said front panel and said top return and said bottom return thereby forming said door section facing into a discrete door section.

4. The door defined in claim 3 wherein at least one discrete door section includes at least one block of wood behind said front panel, said block of wood forming an anchor means of anchoring a separate device to said door.

5. The door defined in claim 1 wherein said closure means comprises a channel member having a generally U-shaped cross section, said channel member being mounted over said peripheral edge to enclose said peripheral edge within said U-shaped cross section.

6. A door comprising:

a plurality of discrete lengths of door section, each of said lengths of door section being fabricated from a steel sheet, said steel sheet being formed with a facing panel having a first end and a second end, said facing panel including a first end stile at said first end and a second end stile at said second end, said discrete lengths of door section being assembled into a planar array to form said door, said planar array having a front surface and a back surface;

a unitary backing sheet affixed to said back surface of said planar array; and a plurality of edge closures for said planar array, said edge closures enclosing the edge of said planar array to form said door.

7. The door defined in claim 6 wherein each of said discrete length of door section includes a body of synthetic foam.

8. The door defined in claim 7 wherein at least one of said discrete length of door section includes a space in said body of foam and a wood block in said space.

9. A method for providing a matching door for a sectional door comprising the steps of:

obtaining a plurality of discrete lengths of door section corresponding to door sections from the sectional door, said discrete lengths of door section being identical to the door sections of the sectional door, each of said discrete length of door section having a premeasured length, said premeasured length corresponding to the width of said matching door, each of said discrete length of door section having a top edge and a bottom edge;

aligning said plurality of discrete lengths of door section into a planar array in an edge to edge relationship and having the identical appearance as the sectional door;

securing a backing sheet on the back surface of said planar array to hold said discrete lengths of door section in alignment to form said matching door; and mounting edge closures on the exposed edges of the periphery of said planar array.

10. The method defined in claim 9 wherein said obtaining step includes preparing each of said plurality of discrete lengths of door section from a facing sheet having a design embossed therein and having a first end and a second end and mounting a first end stile to said first end and a second end stile to said second end.

11. The method defined in claim 10 wherein said preparing step includes inserting a body of synthetic foam into each of said plurality of discrete lengths of door section.

12. The method defined in claim 11 wherein said inserting step includes incorporating a block of wood into a preselected position inside at least one of said discrete length of door section.

13. The method defined in claim 9 wherein said obtaining step includes measuring each of said plurality of discrete lengths of door section thereby providing said door with a predetermined width.

* * * * *